US006997704B2

(12) United States Patent
Crump et al.

(10) Patent No.: US 6,997,704 B2
(45) Date of Patent: Feb. 14, 2006

(54) METHOD AND APPARATUS TO AID IN THE DELUBRIFICATION OF PARTS

(75) Inventors: Matthew W. Crump, Cortland, NY (US); Andrew Johnson, Cortland, NY (US); Ryan Sun, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 114 days.

(21) Appl. No.: 10/765,818

(22) Filed: Jan. 27, 2004

(65) Prior Publication Data

US 2004/0185409 A1 Sep. 23, 2004

Related U.S. Application Data

(60) Provisional application No. 60/450,934, filed on Feb. 28, 2003.

(51) Int. Cl.
*F27B 9/30* (2006.01)

(52) U.S. Cl. ..... 432/128; 432/130; 432/133

(58) Field of Classification Search ..... 432/121, 432/128, 130, 136, 143, 146, 133
See application file for complete search history.

(56) References Cited

U.S. PATENT DOCUMENTS

| | | | | | |
|---|---|---|---|---|---|
| 1,948,440 | A | * | 2/1934 | Milner | 432/194 |
| 5,906,485 | A | * | 5/1999 | Groff et al. | 432/121 |
| 5,919,039 | A | * | 7/1999 | Shaw et al. | 432/121 |
| 6,241,515 | B1 | | 6/2001 | Nayar | 432/128 |
| 6,644,962 | B1 | * | 11/2003 | Sugimoto et al. | 432/47 |

* cited by examiner

*Primary Examiner*—Gregory Wilson
(74) *Attorney, Agent, or Firm*—Brown & Michaels, PC; Greg Dziegielewski

(57) ABSTRACT

A method and apparatus for delubrification of parts. The method comprising the steps of moving the parts on the belt into a chamber of the furnace, heating the parts, igniting the unused combustible atmosphere above the parts, and allowing the atmosphere above the parts to escape through a vent in the chamber. The parts are heated uniformly by a heat source beneath the belt. The hot atmosphere is forced up through at least one plenum by blowers. The unused combustible atmosphere in the chamber above the parts on the belt is ignited using a burner and vented through the vent in the chamber.

20 Claims, 4 Drawing Sheets

METHOD AND APPARATUS TO AID IN THE DELUBRIFICATION OF PARTS

REFERENCE TO RELATED APPLICATIONS

This application claims an invention which was disclosed in Provisional Application No. 60/450,934, filed Feb. 28, 2003, entitled "A METHOD AND APPARATUS TO AID IN THE DELUBRIFICATION OF PARTS". The benefit under 35 USC § 119(e) of the U.S. provisional application is hereby claimed, and the aforementioned application is hereby incorporated herein by reference.

BACKGROUND OF THE INVENTION

1. Field of the Invention

The invention pertains to the field of continuous or batch furnaces. More particularly, the invention pertains to an apparatus added to a continuous or batch furnace to aid in the delubrification of materials or parts.

2. Description of Related Art

Prior art pre-sintering furnaces consists of three heating zones and a cooling section. The prior art furnaces are approximately 520 inches long. While these furnaces are useful for pre-sintering parts they are not sufficient in removing lubrication from parts of larger mass or of large quantity.

The prior art furnace shown in FIG. 1 is comprised of a hood (10), three zones (12, 14, 16), and a cooling section (18). Parts enter the hood (10) and move through the furnace on a belt (not shown) in the direction marked by arrow (20). Slow removal of vapor and gas products away from the surface of the parts due to the inadequate length of the furnace causes soot deposits to form on the exterior surface of the parts that have at least one lubricant present. After the soot has been deposited on the exterior surface of the parts, the parts move into zone 3, where the temperature increases significantly to 1400–1650° F. for pre-sintering, hardening the soot onto the parts.

SUMMARY OF THE INVENTION

A method and apparatus for delubrification of parts. The method comprising the steps of moving the parts on the belt into a chamber of the furnace, heating the parts, igniting the unused combustible atmosphere above the parts, and allowing the atmosphere above the parts to escape through a vent in the chamber. The parts are heated uniformly by a heat source beneath the belt. The hot atmosphere is forced up through at least one plenum by blowers. The unused combustible atmosphere in the chamber above the parts on the belt is ignited using a burner and vented through the vent in the chamber.

DETAILED DESCRIPTION OF THE INVENTION

Figure 1:
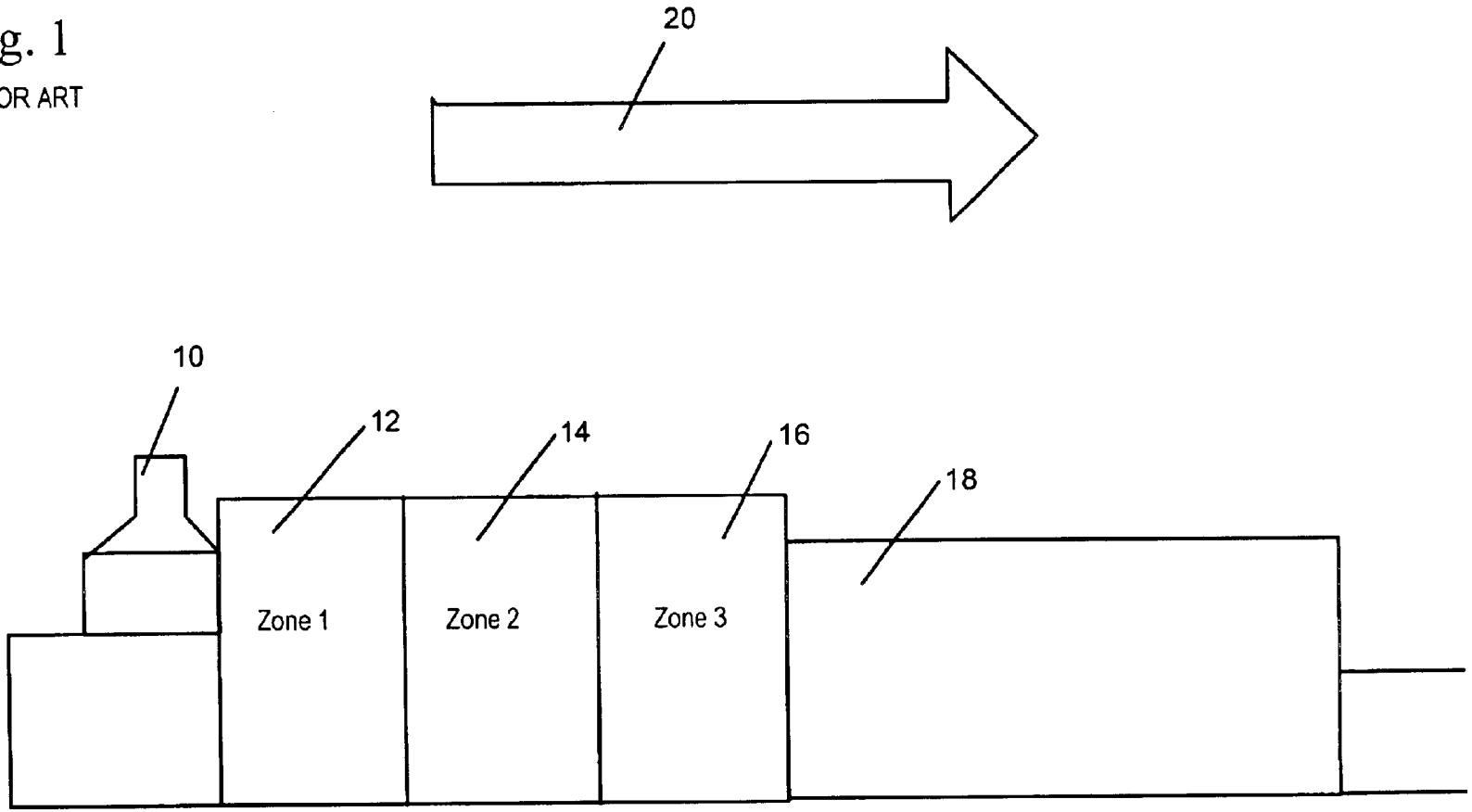
Fig. 1 PRIOR ART
FIG. 1 shows a prior art continuous or batch furnace.
Figure 4:
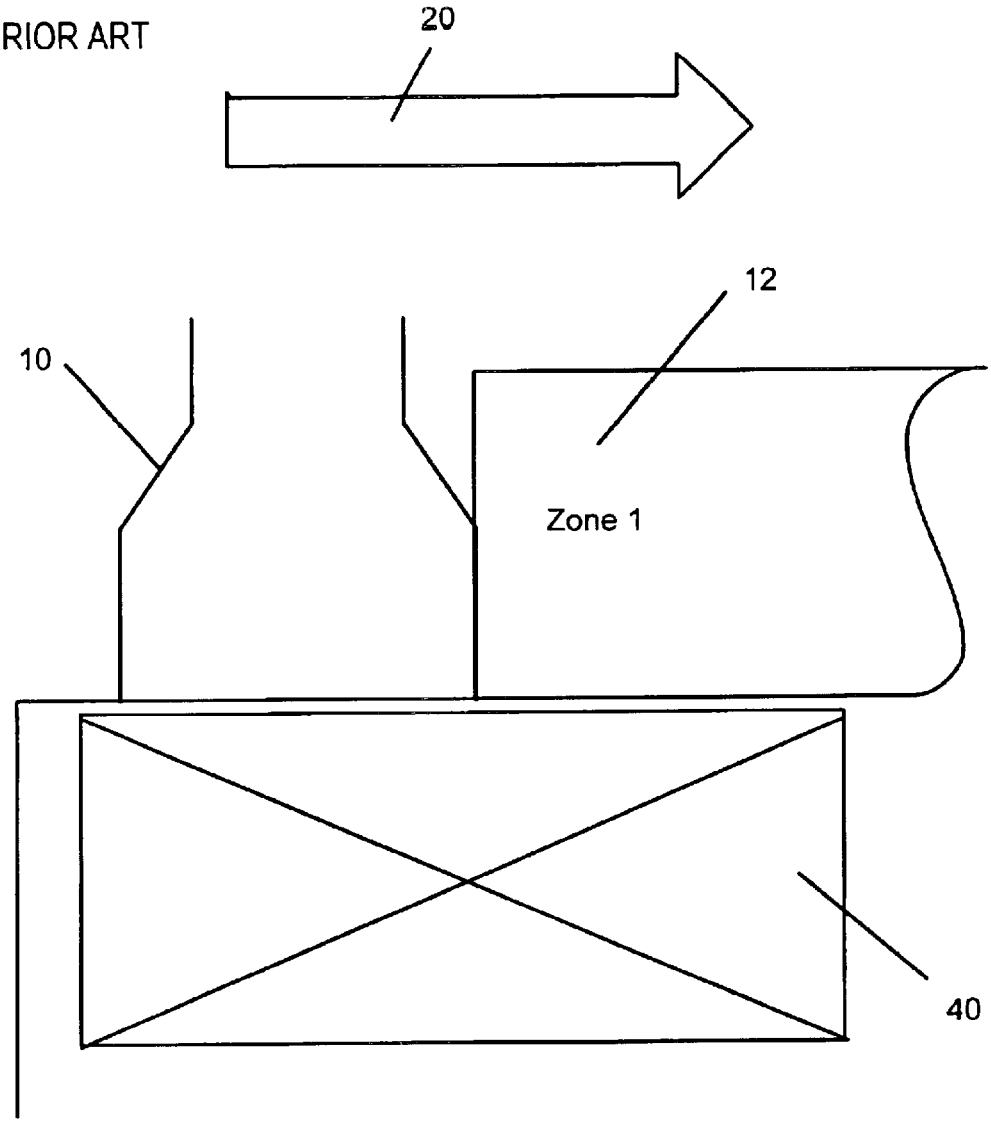
Fig. 4 PRIOR ART
FIG. 4 shows a close up of the prior art continuous or batch furnace.

Prior art FIG. 4 shows a close up of the conventional batch or continuous furnace shown in FIG. 1. A conventional hood or vent (10) is located directly adjacent to zone 1 for pre-sintering. The driving means (40) that controls belt movement is located directly beneath the belt (31).

Figure 2:
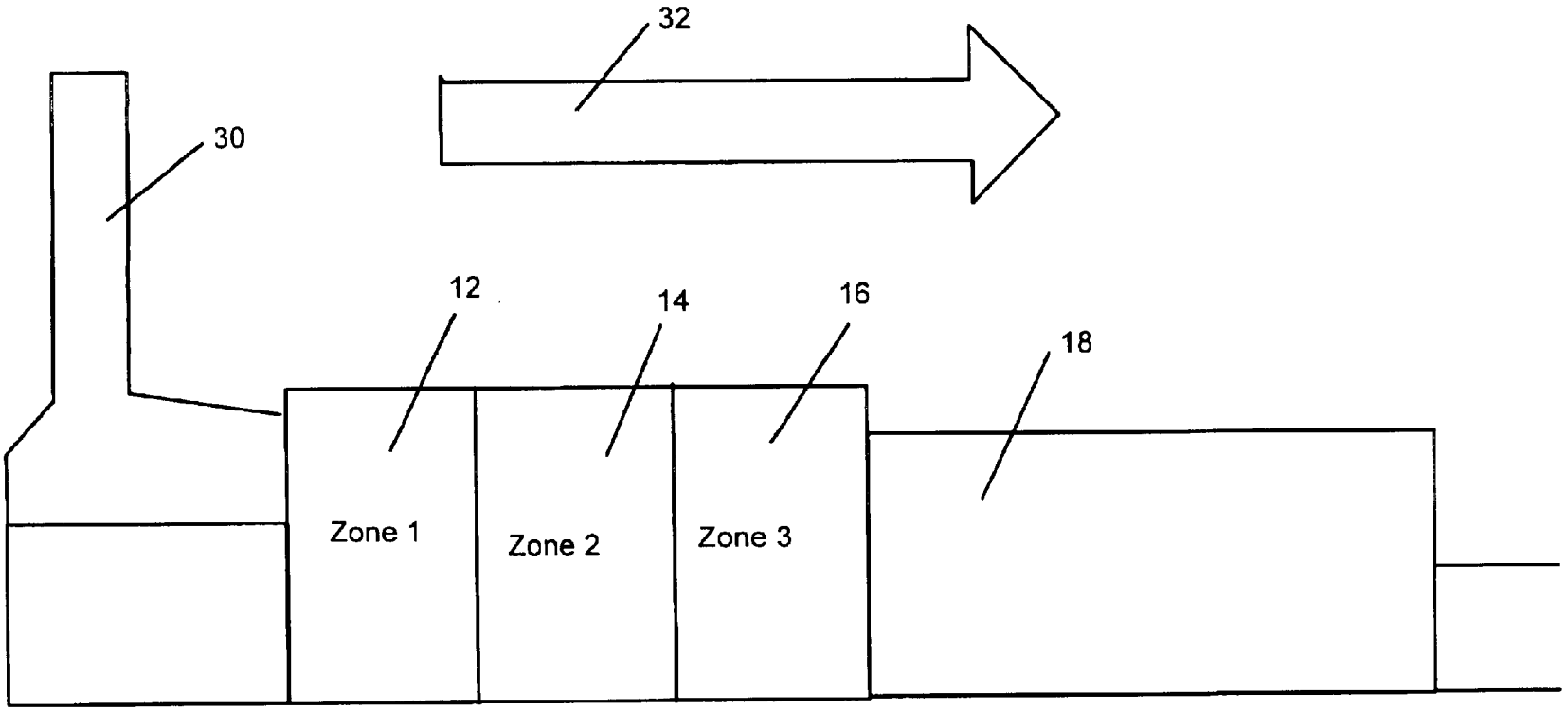
FIG. 2 shows a furnace of the present invention.

Referring to FIG. 2, the furnace of the present invention comprises a hood or vent (30) having an extended chamber adjacent to the three zones (12, 14, 16) and the cooling section (18). Parts move through the furnace in the direction marked by arrow (32).

Figure 3:
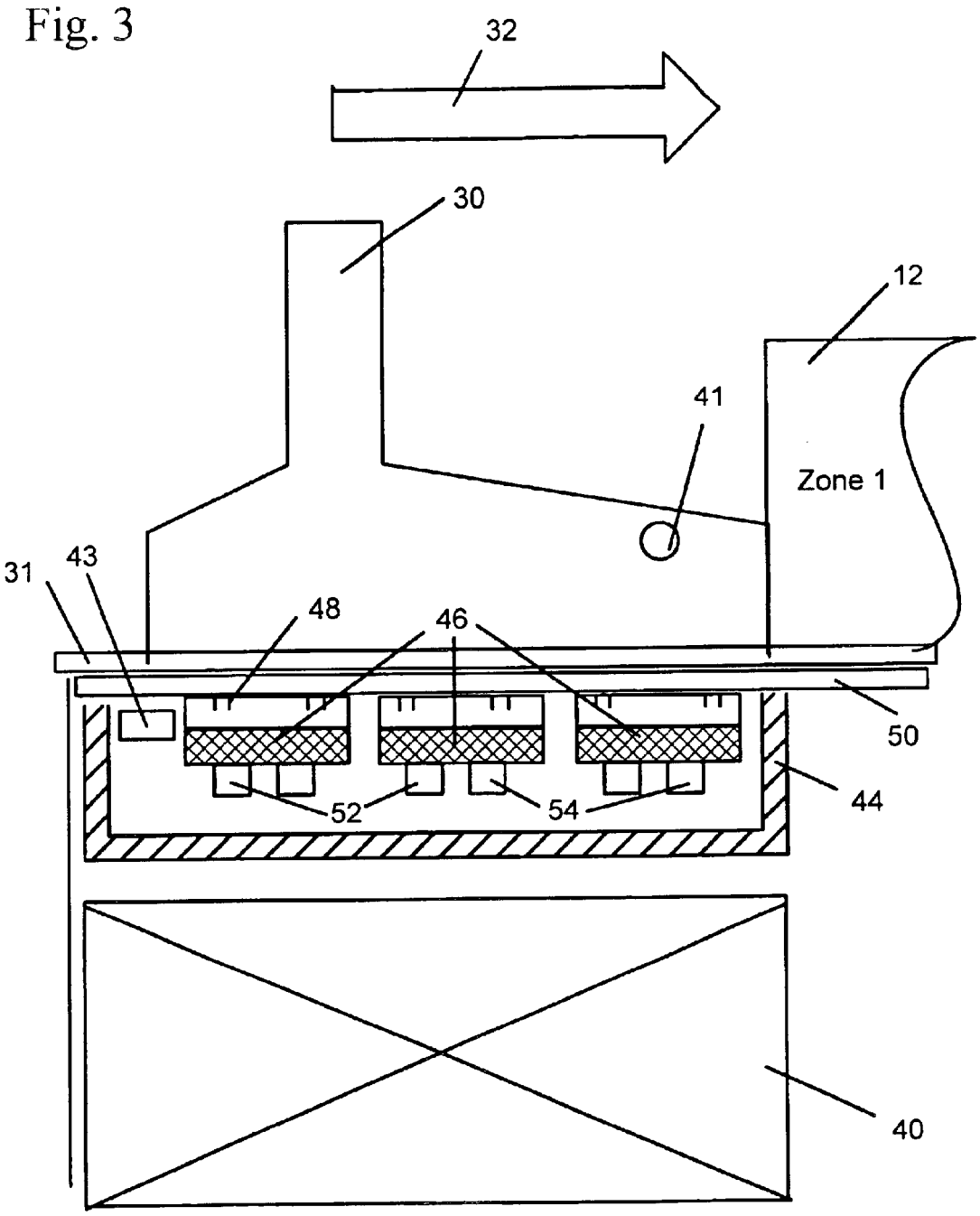
FIG. 3 shows a close up of the present invention.

FIG. 3 shows a close up of the present invention. Parts that need to be pre-sintered are placed on belt (31) and moved through the furnace in the direction marked by arrow (32). The belt (31) can first be heated with a belt warmer (43) present underneath the belt (31). The belt warmer (43) is preferably an electric element that heats up to 100° to 1500° F. The belt warmer (43) and plenums (46) are surrounded by a heat shield (44). The heating of the belt (31) increases the effectiveness of the delubrification process since the belt (31) will have already have been heated and will not absorb any of the heat intended for the parts.

After the belt has been warmed sufficiently, the parts are moved through the hood (30). The hood (30) having an extended chamber in which the parts undergo the delubrification process aids in removing the vaporizing lubricant away and out of the furnace. A pilot burner (41) is also present within the furnace to ignite the unused combustible atmosphere flowing from Zone 1, 2, and 3 of the furnace and the plenums (46). The flame from the ignition of the combustible atmosphere will form an additional heat source above the parts. Likewise, it will also finish burning the lubricant as it is carried away from the parts and up the stack. A separate chamber between a conventional hood and zone 1 may also be used. Furthermore, modifications made to the hood are not limited to the shape shown in the figures. Other heating elements may include but are not limited to stack burners and ribbon burners instead of the pilot burner shown. Modifications to the size and the shape of the chamber are not limited to the shape shown in the figures. How the chamber is created may include but is not limited to curtains or sample ports used to create the separate chamber prior to zone 1.

Adjacent to the belt warmer is a plurality of plenums (46) spanning the length of the hood (30), which for this application is preferably 45". The plenums (46), which can vary in size and number are surrounded by a heat shield (44). The heat shield (44) protects the driving means (40) controlling belt movement. The plenums (46) rest in trays which pull out from the side for easy cleaning. Above the plenums (46) are slots (48) that have been cut in the plate (50) that the belt (31) rides on. The slots allow the plenums (46) to deliver uniform heat over the entire width of the belt (31). Gas burners (52) provide the heat source and blowers (54) force the hot atmosphere, which is either neutral or rich in an oxidizing agent up through the slots, which hits the parts first, carrying the vaporizing lubricant out of the chamber. Temperature and velocity of the atmosphere delivered to the parts by the burner (52) and the blower (54) may be independently controlled for each plenum. The temperature range for the plenum is preferably 400 to 1600° F. with a pressure range of 5 to 100 psi and a volume range of 20 to 2000 cfm.

After the parts have started to or have been delubricated, the parts enter zone 1 and move into the zone 2 to continue the delubrification process. Starting in zone 2 and through zone 3 the parts are pre-sintered. Finally, they enter the cooling zone.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of delubrification of parts containing lubricant on a belt comprising:

a) heating the belt with a belt warmer before placing parts on the belt;

b) place parts on the belt;

c) moving the parts on the belt into a chamber of the furnace, the chamber having a vent for removing combustible atmosphere;

d) heating the parts uniformly from underneath the belt, by forcing hot atmosphere through the belt;

e) igniting unused combustible atmosphere in the chamber above the parts on the belt, using a burner; and f) allowing the atmosphere above the parts to escape through the vent.

2. The method of claim 1, wherein the belt warmer is an electric element.

3. The method of claim 2, wherein the electric element applies heat in a range of 100° F. to 1500° F.

4. The method of claim 1, further comprising a heat shield surrounding the belt warmer, at least one blower, and at least one source of hot atmosphere.

5. The method of claim 4, further comprising the step of independently controlling the at least one blower and the at least on source of hot atmosphere.

6. The method of claim 4, wherein the at least one blower applies a pressure range of 5 to 100 psi and a volume range of 20 to 2000 cfm.

7. The method of claim 1, wherein the hot atmosphere has a temperature range of 400° F. to 1600° F.

8. The method of claim 1, wherein the hot atmosphere is air.

9. The method of claim 1, wherein the hot atmosphere is rich in an oxidizing agent.

10. A delubrification apparatus for use with a furnace, the apparatus comprising:

a vented chamber for receiving a belt, carrying parts containing lubricant;

at least one plenum located beneath the belt, the plenums each having a heat source and blower to provide uniform heat to the parts on the belt; and a burner above the parts on the belt for igniting unused combustible atmosphere in the vented chamber, and wherein the blower of each plenum forces the atmosphere around the parts containing lubricant to exit the vented chamber through a vent.

11. The apparatus of claim 10, further comprising a belt warmer for heating the belt.

12. The apparatus of claim 11, wherein the belt warmer is surrounded by a heat shield.

13. The apparatus of claim 11, wherein the belt warmer is an electric element.

14. The apparatus of claim 13, wherein the electric element applies heat in a range of 100° F. to 1500° F.

15. The apparatus of claim 10, wherein the at least one plenum is surrounded by a heat shield.

16. The apparatus of claim 10, wherein the heat source and the blower underneath the belt are independently controlled.

17. The apparatus of claim 10, wherein the heat source of the at least one plenum applies a temperature in the range of 400° F. to 1600° F.

18. The apparatus of claim 10, wherein the blowers of the at least one plenum applies a pressure range of 5 to 100 psi and a volume range of 20 to 2000 cfm.

19. The apparatus of claim 10, wherein the hot atmosphere is air.

20. The apparatus of claim 10, wherein the hot atmosphere is rich in an oxidizing agent.

* * * * *

UNITED STATES PATENT AND TRADEMARK OFFICE

CERTIFICATE OF CORRECTION

PATENT NO. : 6,997,704 B2
DATED : February 14, 2006
INVENTOR(S) : Crump et al.

It is certified that error appears in the above-identified patent and that said Letters Patent is hereby corrected as shown below:

Column 3,
Line 10, delete "place" and insert -- placing --.

Signed and Sealed this

Second Day of May, 2006

JON W. DUDAS
*Director of the United States Patent and Trademark Office*